US005740819A

United States Patent [19]

Hicks

[11] Patent Number: 5,740,819

[45] Date of Patent: Apr. 21, 1998

[54] PROCESS FOR SECURING SUPPLEMENTAL HAIR TO THE NATURAL HAIR OF AN INDIVIDUAL

[76] Inventor: Janice A. Hicks, P.O. Box 1861, Tucker, Ga. 30085-1861

[21] Appl. No.: 744,617

[22] Filed: Nov. 6, 1996

[51] Int. Cl.[6] ..... A41G 3/00

[52] U.S. Cl. ..... 132/201

[58] Field of Search ..... 132/201, 53, 54, 132/55, 56

[56] References Cited

U.S. PATENT DOCUMENTS

| | | | |
|---|---|---|---|
| 2,865,380 | 12/1958 | Mitchell | 132/53 |
| 4,934,387 | 6/1990 | Megna | 132/201 |
| 5,107,867 | 4/1992 | Barrington | 132/201 |
| 5,121,761 | 6/1992 | Meister | 132/201 |
| 5,357,986 | 10/1994 | Hargrett | 132/201 |
| 5,634,478 | 6/1997 | Shakir | 132/201 |

FOREIGN PATENT DOCUMENTS

| | | | |
|---|---|---|---|
| 611530 | 8/1994 | European Pat. Off. | 132/201 |
| 4308207 | 10/1992 | Japan | 132/53 |

*Primary Examiner*—Todd E. Manahan
*Attorney, Agent, or Firm*—Joseph N. Breaux

[57] ABSTRACT

A process for securing supplemental hair to a persons natural hair including forming a bound weft of supplemental hair by binding a weft of supplemental hair around a binding portion of the weft located between three and six inches from a first end thereof by sewing a series of blanket stitches around the binding portion with a length of thread and then pulling the thread taut to create a bound weft leaving a top length and a bottom length of thread extending from the binding portion; and then utilizing a combination of braiding and sewing to secure the bound weft of supplemental hair to a persons natural hair.

12 Claims, 3 Drawing Sheets

PROCESS FOR SECURING SUPPLEMENTAL HAIR TO THE NATURAL HAIR OF AN INDIVIDUAL

TECHNICAL FIELD

The present invention relates to processes for attaching supplemental hair to a persons natural hair and more particularly to a process for securing supplemental hair to a persons natural hair that includes forming a bound weft of supplemental hair and then utilizes a combination of braiding and sewing to secure the bound weft of supplemental hair to a persons natural hair.

BACKGROUND OF THE INVENTION

Individuals with short or thin hair often desire to supplement their existing natural hair with supplemental hair. This supplemental hair is attached to the natural hair or scalp of the individual. The problem with existing methods of securing the supplemental hair to the natural hair of the individual is the supplemental hair can often come loose and fall out. In addition, individuals with supplemental hair are often restricted in the manner in which they can wash or style their hair once the supplemental hair is in place. It would be a benefit, therefore, to have a process for securing wefts of supplemental hair to the natural hair of an individual that would result in a secure attachment. It would be a further benefit to have such a process that resulted in a securement between the natural hair of the individual and the wefts of supplemental hair that could withstanding conventional shampooing and styling. It would of course be a benefit to have such a process that could be easily reversed and that did not result in damage to the existing natural hair of the individual.

SUMMARY OF THE INVENTION

It is thus an object of the invention to provide a process for securing wefts of supplemental hair to the natural hair of an individual that results in a secure, concealable attachment.

It is a further object of the invention to provide a process for securing supplemental hair to the natural hair of an individual that results in a securement that withstands conventional shampooing and styling.

It is a still further object of the invention to provide a process for securing supplemental hair to the natural hair of an individual that is easily reversed and that does not result in damage to the existing natural hair of the individual.

It is a still further object of the invention to provide a process for securing supplemental hair to the natural hair of an individual that accomplishes all or some of the above objects in combination.

Accordingly, a process for securing supplemental hair to the natural hair of an individual is provided. The process includes the steps of 1) providing a weft of supplemental hair; 2) providing a length of thread and a curved sewing needle; 3) binding the weft of supplemental hair around a binding portion of the weft located between three and six inches from a first end thereof by sewing a series of blanket stitches around the binding portion and then pulling the thread taut to create a bound weft leaving a top length and a bottom length of thread extending from the binding portion, the binding portion separating the bound weft into an upper weft portion and a lower weft portion; 4) defining a row of natural hair on the head of the individual to receive the supplemental hair; 5) defining first and second strands of hair from the row that are adjacent to each other; 6) separating the two strands to form a V-shaped notch at the scalp of the individual; 7) positioning the binding portion of the bound weft into the notch against the scalp with the upper weft portion and the top length of thread positioned above the row and the bottom weft portion and the bottom length of thread positioned below the row; 8) braiding the bottom and top weft portions with the first and second strands; 9) inserting the ends of the top and bottom length of thread through the eye of the curved needle; 10) sewing a plurality of blanket stitches around a base end of the braid and then pulling the thread taught; 11) sewing a plurality of blanket stitches up through the center of the braid; 12) sewing a plurality of blanket stitches around the first and second strands between the top of the braid and the scalp and then pulling the thread taut; 13) inserting the needle through the braid and exiting through the bottom of the braid; and then 14) severing the remaining thread extending past the bottom of the braid.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
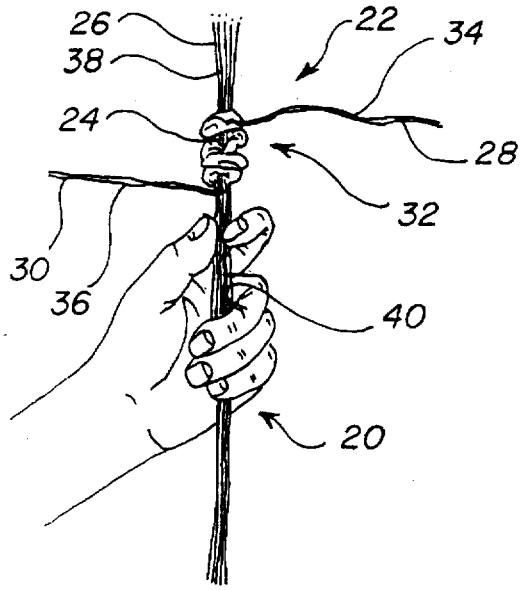
FIG. 1 is a plan view showing a weft of supplemental hair being bound by the length of thread around a binding portion thereof, leaving a top length and a bottom length of thread extending from the binding portion, and the binding portion separating the bound weft into an upper weft portion and a lower weft portion.

An exemplary process for securing supplemental hair to the natural hair of an individual of the present invention is now described with reference to FIGS. 1–11. With reference to FIG. 1, the process includes providing a weft of supplemental human hair, generally designated 20, of a color and texture matching the natural hair of the individual to receive the supplemental hair. Once the hair color and hair type is selected, a length of upholstery thread 22 that matches the color of weft 20 is supplied for binding weft 20 into a bound weft 32 and later for securing bound weft 32 to the natural hair of the individual. Thread 22 is used to bind weft 20 around a binding portion 24 thereof. Binding portion 24 is located five inches from a first end 26 of weft 20. Thread 22 is sewn around binding portion 24 by sewing a series of blanket stitches around binding portion 24 and then pulling the ends 28,30 of thread 22 taut to create bound weft, generally designated by the numeral 32. A top length of thread 34 and a bottom length of thread 36 are left extending from binding portion 24 for later use. Bound weft 32 includes an upper weft portion 38 and a lower weft portion 40 that are divided by binding portion 24.

Figure 2:
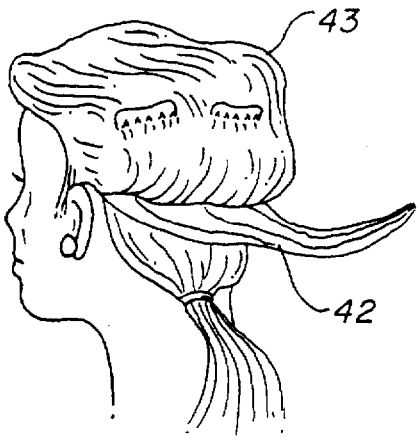
FIG. 2 is a plan view showing the head of a representative individual with the hair separated to form a row of natural hair for receiving the supplemental hair.
Figure 3:
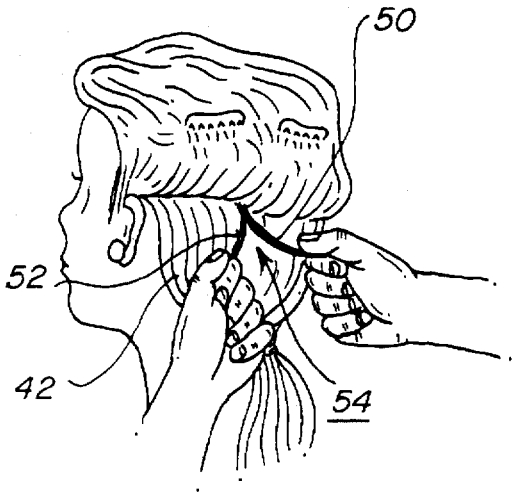
FIG. 3 is a plan view showing the first and second strands of hair defined from the row and then separated to form a V-shaped notch at the scalp of the individual.
Figure 4:
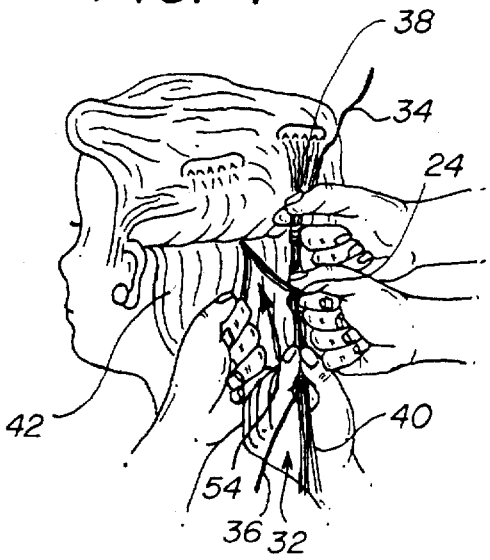
FIG. 4 is a plan view showing positioning of the binding portion into the notch against the scalp with the upper weft portion and the top length of thread positioned above the row and the bottom weft portion and the bottom length of thread positioned below the row.

With reference to FIG. 2, once a bound weft 32 is constructed, a row 42 of natural hair is defined on the head 43 of the individual. Now referring to FIG. 3, hair from row 42 is then gathered from adjacent section of row 42 to form a first strand 50 and a second strand 52. First and second strands 50,52 are preferably about one-thirty-second inch thick and composed of hair about three inches long.

The ends of first and second strands 50,52 are then moved apart to form a V-shaped notch 54 at the scalp of the individual. Now referring to FIG. 4, binding portion 24 of bound weft 32 is then placed into notch 54 against the scalp with upper weft portion 38 and top length of thread 34 positioned above row 42 and lower weft portion 40 and bottom length of thread 36 positioned below row 42.

Figure 5:
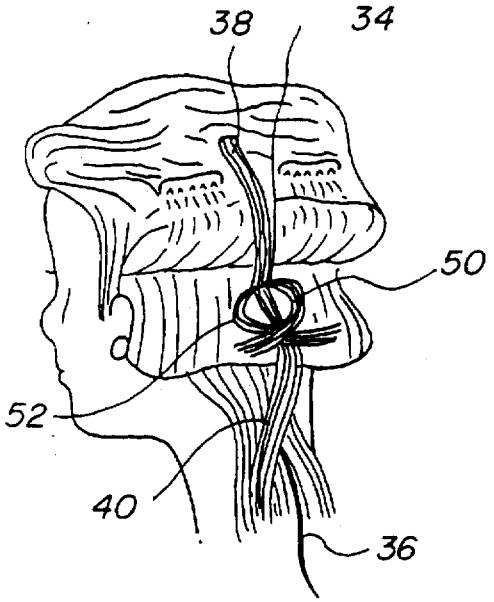
FIG. 5 is a plan view showing braiding of the bottom and top weft portions with the first and second strands.
Figure 6:
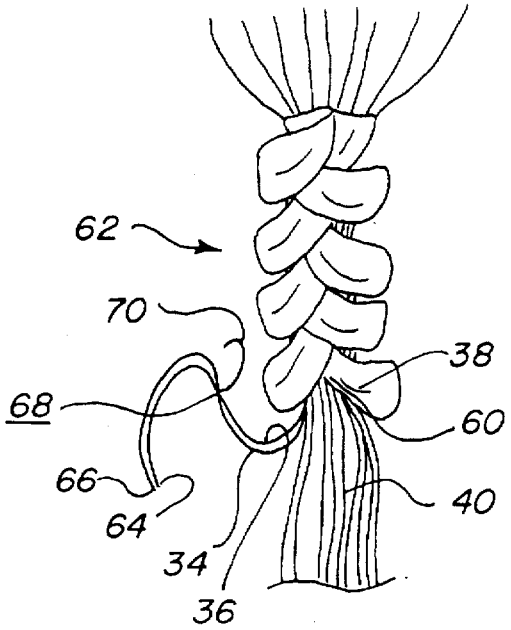
FIG. 6 is a plan view showing the bottom and top weft portions with the first and second strands braided and the ends of the top and bottom length of thread inserted through the eye of the curved needle.

Referring to FIG. 5, lower and upper weft portions 40,38, including top length of thread 34 and bottom length of thread 36 are then braided with first and second strands 50,52 in a four strand braiding movement requiring two people wherein one person crosses his/her hands in a right over left movement and the other person crosses his/her hands in a left over right movement until, referring to FIG. 6, upper weft portion 38 is completely braided and top length of thread 34 and bottom length of thread 36 extend down from a base end 60 of the completed braid 62. Completed braid 62 should be of a length of between one-half and one and one-quarter inches in length and is preferably between three-quarters and one inch in length. The ends 64,66 of top and bottom lengths of thread 34,36 are gathered together then inserted through the eye 68 of a curved needle 70.

Figure 7:
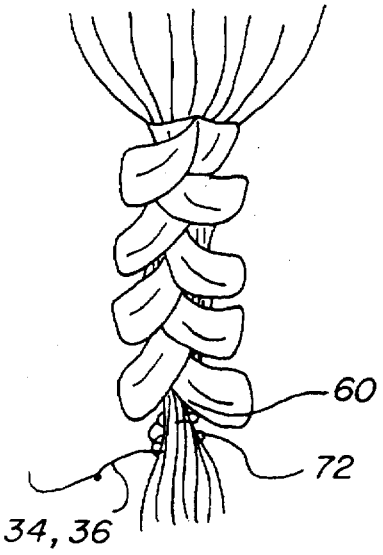
FIG. 7 is a plan view showing three blanket stitches formed around the base end of the braid.
Figure 8:
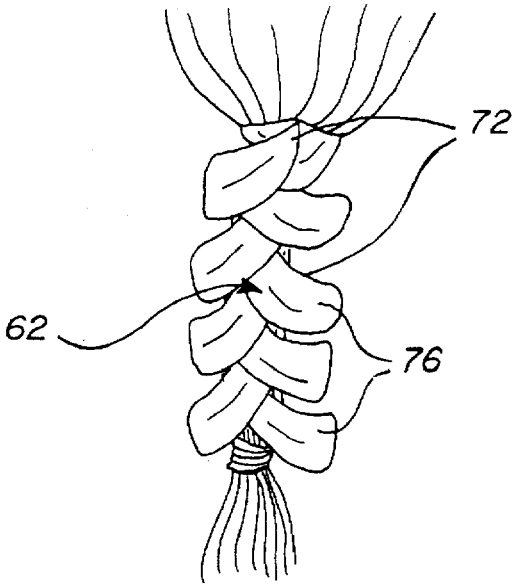
FIG. 8 is a plan view showing the three blanket stitches formed around the base end of the braid with the thread pulled taut and blanket stitches being sewn up through the center of the braid.
Figure 9:
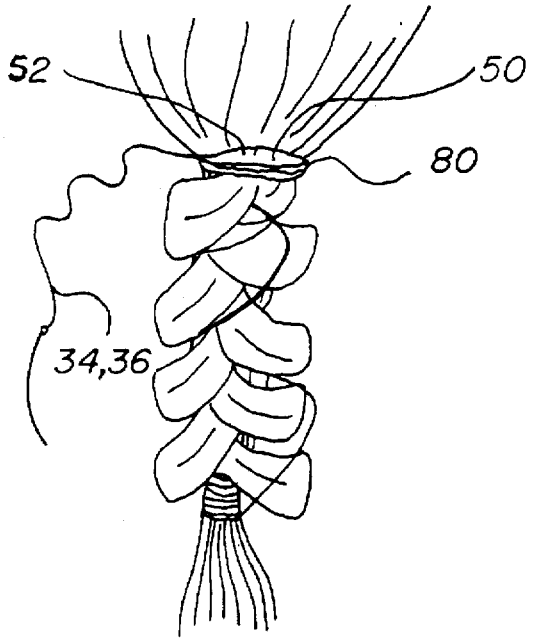
FIG. 9 is a plan view showing three blanket stitches formed around the first and second strands between the top of the braid and the scalp.

Referring to FIG. 7, three blanket stitches 72 are then sewn around base end 60 and the thread 34,36 pulled taut. Referring to FIG. 8, blanket stitches 76 are then sewn up through the center line of braid 62 to the top end 78 is reached. Referring to FIG. 9, three blanket stitches 80 are then sewn around first and second strands 50,52 and thread 34,36 pulled taut.

Figure 10:
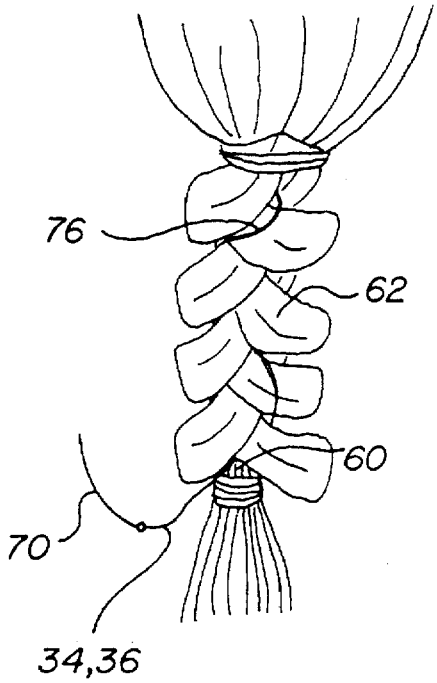
FIG. 10 is a plan view showing the thread inserted back down through the braid and exiting through the bottom of the braid.
Figure 11:
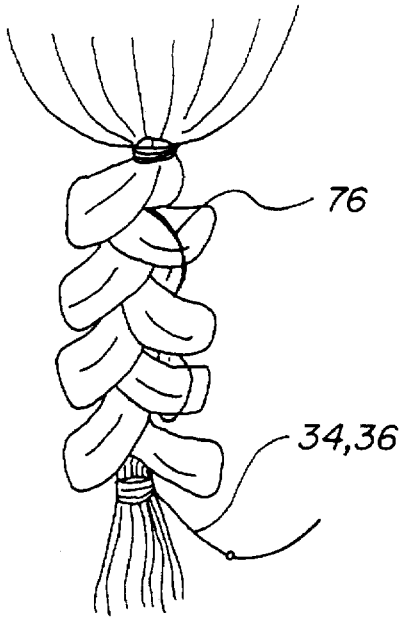
FIG. 11 is a plan view showing the supplemental hair weft finally secured in place prior to severing the remaining thread.

Referring to FIG. 10, curved needle 70 is then inserted down through braid 62 and out through base end 60 thereof. Referring to FIG. 11, any remaining thread 34,36 extending past base end 60 is then severed and discarded.

The previous steps are then repeated until the desired number of supplemental hair has been secured into place. If the person receiving the supplemental hair has fine or thin hair, liquid resin can be applied to strands 50,52 to provide additional holding. Also, when natural supplemental hair is used, care must be taken to see that the cuticle of the supplemental hair is properly aligned with the existing natural hair. It has been found by the inventor hereof that supplemental hair secured according to the foregoing process stays securely in place for an extended period of time even when subjected to normal styling and shampooing methods. In addition, the supplemental hair can be removed without damaging the natural hair of the individual by severing the thread 22 and unbraiding the bound weft 32 and the natural hair.

It can be seen from the preceding description that a process for securing wefts of supplemental hair to the natural hair of an individual has been provided that results in a secure attachment; that results in a securement that withstands conventional shampooing and styling; that is easily reversed; and that does not result in damage to the existing natural hair of the individual.

It is noted that the embodiment of the process for securing supplemental hair to the natural hair of an individual described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A process for securing supplemental hair to the natural hair of an individual comprising:

1) providing a weft of supplemental hair;

2) providing a length of thread;

3) binding said weft of supplemental hair around a binding portion of said weft located between three and six inches from a first end of said weft of supplemental hair by forming a series of stitches around said binding portion and then pulling said thread taut to create a bound weft in a manner to leave a top length and a bottom length of thread extending from said binding portion, said binding portion separating said bound weft into an upper weft portion and a lower weft portion;

4) defining a row of natural hair on a head of said individual to receive said supplemental hair;

5) defining first and second strands of hair from said row that are adjacent to each other;

6) separating said two strands to form a V-shaped notch at a scalp of said individual;

7) positioning said binding portion of said bound weft into said notch against the scalp of the individual in a manner such that said upper weft portion and said top length of thread are positioned above said row and said bottom weft portion and said bottom length of thread are positioned below said row;

8) braiding said bottom and top weft portions with said first and second strands to form a braid;

9) providing a curved needle having an eye formed at one needle end thereof;

9) inserting a first end of said top thread and a second end of said bottom length of thread through said eye of said curved needle;

10) sewing a plurality of blanket stitches around a base end of said braid and then pulling said thread taught;

11) sewing a plurality of blanket stitches up through a center of said braid;

12) sewing a plurality of blanket stitches around said first and second strands between said top of said braid and said scalp and then pulling said thread taut;

13) inserting said needle through said braid and exiting through a bottom of said braid; and then 14) severing any remaining thread extending past said bottom of said braid.

2. The process for securing supplemental hair to the natural hair of an individual of claim 1, wherein:

the step of sewing said plurality of blanket stitches around a base end of said braid and then pulling said thread taught is performed prior to the step of sewing a plurality of blanket stitches up through a center of said braid.

3. The process for securing supplemental hair to the natural hair of an individual of claim 2, wherein:

the step of sewing a plurality of blanket stitches up through a center of said braid is performed prior to the step of sewing a plurality of blanket stitches around said first and second strands between said top of said braid and said scalp and then pulling said thread taut.

4. The process for securing supplemental hair to the natural hair of an individual of claim 3 wherein:

the step of sewing a plurality of blanket stitches around said first and second strands between said top of said braid and said scalp and then pulling said thread taut is performed prior to the step of inserting said needle through said braid and exiting through a bottom of said braid.

5. The process for securing supplemental hair to the natural hair of an individual of claim 1 wherein:

said strands are formed in a manner such that each said strand is about one-thirty-second inch thick.

6. The process for securing supplemental hair to the natural hair of an individual of claim 1 wherein:

in the step of binding said weft of supplemental hair around said binding portion, said series of stitches formed include three blanket stitches.

7. The process for securing supplemental hair to the natural hair of an individual of claim 6 wherein:

said binding portion of said weft of supplemental hair is selected to be located five inches from said first end of said weft of supplemental hair.

8. The process for securing supplemental hair to the natural hair of an individual of claim 7, wherein:

the step of sewing said plurality of blanket stitches around a base end of said braid and then pulling said thread taught is performed prior to the step of sewing a plurality of blanket stitches up through a center of said braid.

9. The process for securing supplemental hair to the natural hair of an individual of claim 8, wherein:

the step of sewing a plurality of blanket stitches up through a center of said braid is performed prior to the step of sewing a plurality of blanket stitches around said first and second strands between said top of said braid and said scalp and then pulling said thread taut.

10. The process for securing supplemental hair to the natural hair of an individual of claim 9 wherein:

the step of sewing a plurality of blanket stitches around said first and second strands between said top of said braid and said scalp and then pulling said thread taut is performed prior to the step of inserting said needle through said braid and exiting through a bottom of said braid.

11. The process for securing supplemental hair to the natural hair of an individual of claim 10 wherein:

said strands are formed in a manner such that each said strand is about one-thirty-second inch thick.

12. The process for securing supplemental hair to the natural hair of an individual of claim 1 wherein:

said braid is between three-quarters and one inch in length.

* * * * *